US007616112B2

(12) United States Patent
Miller, III

(10) Patent No.: US 7,616,112 B2
(45) Date of Patent: Nov. 10, 2009

(54) BI-PLY FABRIC CONSTRUCTION HAVING A DORMANT GLOBAL POSITIONING SYSTEM FORMED THEREWITH

(75) Inventor: Robert A. Miller, III, New Ringgold, PA (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 1062 days.

(21) Appl. No.: 11/057,818

(22) Filed: Feb. 14, 2005

(65) Prior Publication Data

US 2005/0252249 A1 Nov. 17, 2005

Related U.S. Application Data

(63) Continuation-in-part of application No. 10/764,349, filed on Jan. 23, 2004, now Pat. No. 6,854,296.

(51) Int. Cl.
*G08B 1/08* (2006.01)

(52) U.S. Cl. ..... 340/539.13; 340/539.11; 701/213; 342/357.06

(58) Field of Classification Search ..... 340/539.13, 340/539.11; 701/213; 342/357.06, 357.07
See application file for complete search history.

(56) References Cited

U.S. PATENT DOCUMENTS

| | | | |
|---|---|---|---|
| 709,734 | A | 9/1902 | Bellis |
| 2,879,654 | A | 3/1959 | Evans |
| 3,806,959 | A | 4/1974 | Gross |
| 3,859,824 | A | 1/1975 | Krylov et al. |
| 3,930,387 | A | 1/1976 | Imamura |
| 3,986,374 | A | 10/1976 | Fane |
| 3,986,530 | A | 10/1976 | Maekawa |
| 4,158,292 | A | 6/1979 | Ehedy et al. |
| 4,199,633 | A | 4/1980 | Blore |
| 4,244,197 | A | 1/1981 | Althammer |
| 4,278,717 | A | 7/1981 | Aoyama |
| 4,335,589 | A | 6/1982 | Flasher |
| 4,583,547 | A | 4/1986 | Granek et al. |
| 4,628,709 | A | 12/1986 | Aeschbach et al. |
| 4,639,545 | A | 1/1987 | Pithouse et al. |
| 4,672,825 | A | 6/1987 | Yasukawa et al. |
| 4,729,377 | A | 3/1988 | Granek et al. |
| 4,753,088 | A | 6/1988 | Harrison et al. |
| 4,771,614 | A | 9/1988 | Kemp |
| 4,787,219 | A | 11/1988 | Sato et al. |
| 4,815,299 | A | 3/1989 | Bryant |

(Continued)

FOREIGN PATENT DOCUMENTS

| | | | |
|---|---|---|---|
| EP | 546962 | A1 | 12/1991 |

*Primary Examiner*—Eric M Blount
(74) *Attorney, Agent, or Firm*—Womble Carlyle Sandridge & Rice, PLLC

(57) ABSTRACT

An article of apparel is provided for determining location information via a global positioning system and transmitting the location information to a remote location. The article of apparel comprises a fabric web having at least one yarn of wire formed within the fabric web. The yarn of wire forms an antenna for receipt and transmission of radio frequency signals. A GPS receiver is interconnected to the antenna, wherein the GPS receiver determines a location of the article of apparel via a global positioning system. A transmitter is provided to transmit the location of the article of apparel determined by the GPS receiver. A power supply is interconnected to the GPS receiver and the transmitter.

21 Claims, 4 Drawing Sheets

U.S. PATENT DOCUMENTS 4,839,482 A 6/1989 Ackermann et al.
4,856,299 A 8/1989 Bryant
4,921,751 A 5/1990 Wakahara et al.
5,013,089 A 5/1991 Abu-Isa et al.
5,023,430 A 6/1991 Brekkestran et al.
5,105,067 A 4/1992 Brekkestran et al.
5,147,714 A 9/1992 Ellison et al.
5,148,002 A * 9/1992 Kuo et al. ..... 219/211
5,151,319 A 9/1992 Schoutteten
5,157,379 A 10/1992 Dennison
5,229,181 A 7/1993 Daiber et al.
5,310,590 A 5/1994 Tochacek et al.
5,364,678 A 11/1994 Lumb et al.
5,373,713 A 12/1994 Miller
5,382,466 A 1/1995 Ingham
5,395,684 A 3/1995 Robinson et al.
5,422,153 A 6/1995 Miyamoto
5,472,769 A 12/1995 Goerz, Jr. et al.
5,545,470 A 8/1996 Schuster et al.
5,636,533 A 6/1997 Hunneke et al.
5,641,560 A 6/1997 Schmidt et al.
5,651,847 A 7/1997 Loeffler
5,825,327 A * 10/1998 Krasner ..... 342/357.09
6,259,399 B1 * 7/2001 Krasner ..... 342/357.06
6,324,053 B1 * 11/2001 Kamijo ..... 361/679.03
6,377,216 B1 * 4/2002 Cheadle et al. ..... 343/700 MS
6,396,403 B1 * 5/2002 Haner ..... 340/573.4
6,483,469 B2 * 11/2002 Boyle ..... 343/718
6,545,606 B2 * 4/2003 Piri et al. ..... 340/573.1
6,727,197 B1 4/2004 Wilson et al.
6,755,050 B2 6/2004 Lindskog
6,771,224 B2 8/2004 Apostolos
7,038,589 B2 * 5/2006 Schmidt et al. ..... 340/573.1
2001/0022096 A1 9/2001 Orima
2001/0024949 A1 * 9/2001 Yanagida et al. ..... 455/404
2001/0055243 A1 12/2001 Haywood
2002/0134116 A1 9/2002 Sandbach
2003/0129905 A1 7/2003 Dhawan et al.
2008/0125288 A1 * 5/2008 Case ..... 482/1

* cited by examiner

BI-PLY FABRIC CONSTRUCTION HAVING A DORMANT GLOBAL POSITIONING SYSTEM FORMED THEREWITH

RELATED APPLICATIONS

This is a continuation-in-part of application Ser. No. 10/764,349, filed Jan. 23, 2004, now U.S. Pat. No. 6,854,296, the content of which is incorporated herein in its entirety.

FIELD OF THE INVENTION

The present invention relates to the field of textile production, and more particularly, to a fabric construction having a global positioning system formed therewith.

BACKGROUND OF THE INVENTION

In recent years, global positioning technology has developed for precisely geographically locating objects and/or individuals. Recently, portable, hand-held devices may been introduced; however, they must be secured in a pocket or backpack. Further, the small or short built-in, or external, antennae of these devices have a rather limited range for reception of radio frequency, line of sight signals.

DETAILED DESCRIPTION OF THE PREFERRED EMBODIMENTS

Certain exemplary embodiments of the present invention are described below and illustrated in the attached Figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications and improvements are within the scope of the present invention.

In parent application Ser. No. 10/764,349, filed Jan. 23, 2004, now pending, there is described in detail a bi-ply fabric construction in which conductive wires or yarns may be laid in between two knitted confronting fabric webs. For convenience, FIGS. 1 through 4B, which are representative of those included in the pending application, are included herein for reference to that fabric construction. The same or a similar fabric construction is suitable for incorporation of the exemplary embodiments that follow. As can be appreciated, however, the fabric may comprise only a single web and may be formed as a knitted web, woven web, or non-woven web.

Figure 1:
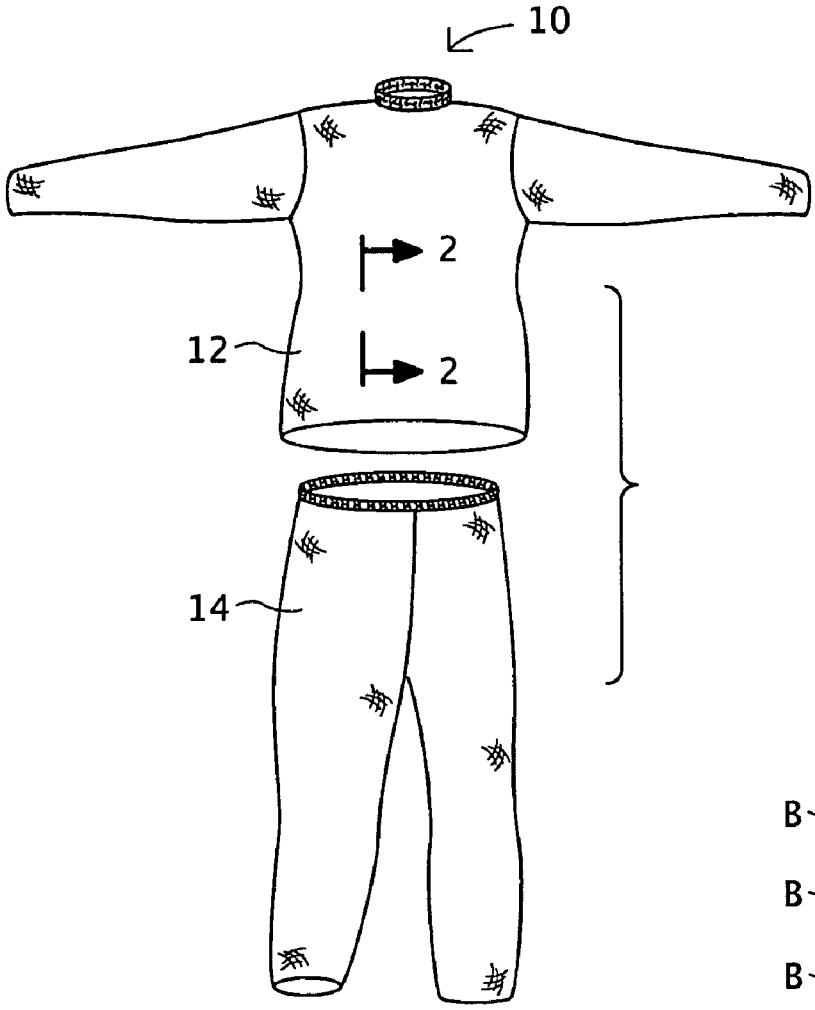
FIG. 1 is a view of a garment incorporating the bi-ply fabric of the present invention.
Figure 2:
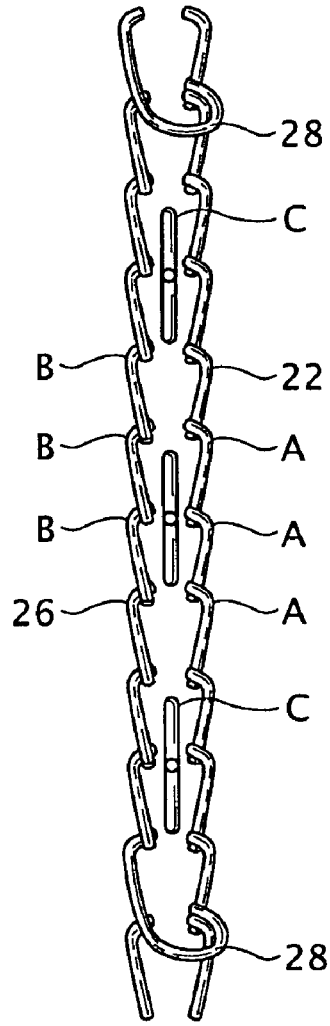
FIG. 2 is a sectional view of the bi-ply fabric of the present invention taken along Line 2-2 of FIG. 1 when the fabric is in a relaxed condition in the course direction.
Figure 3:
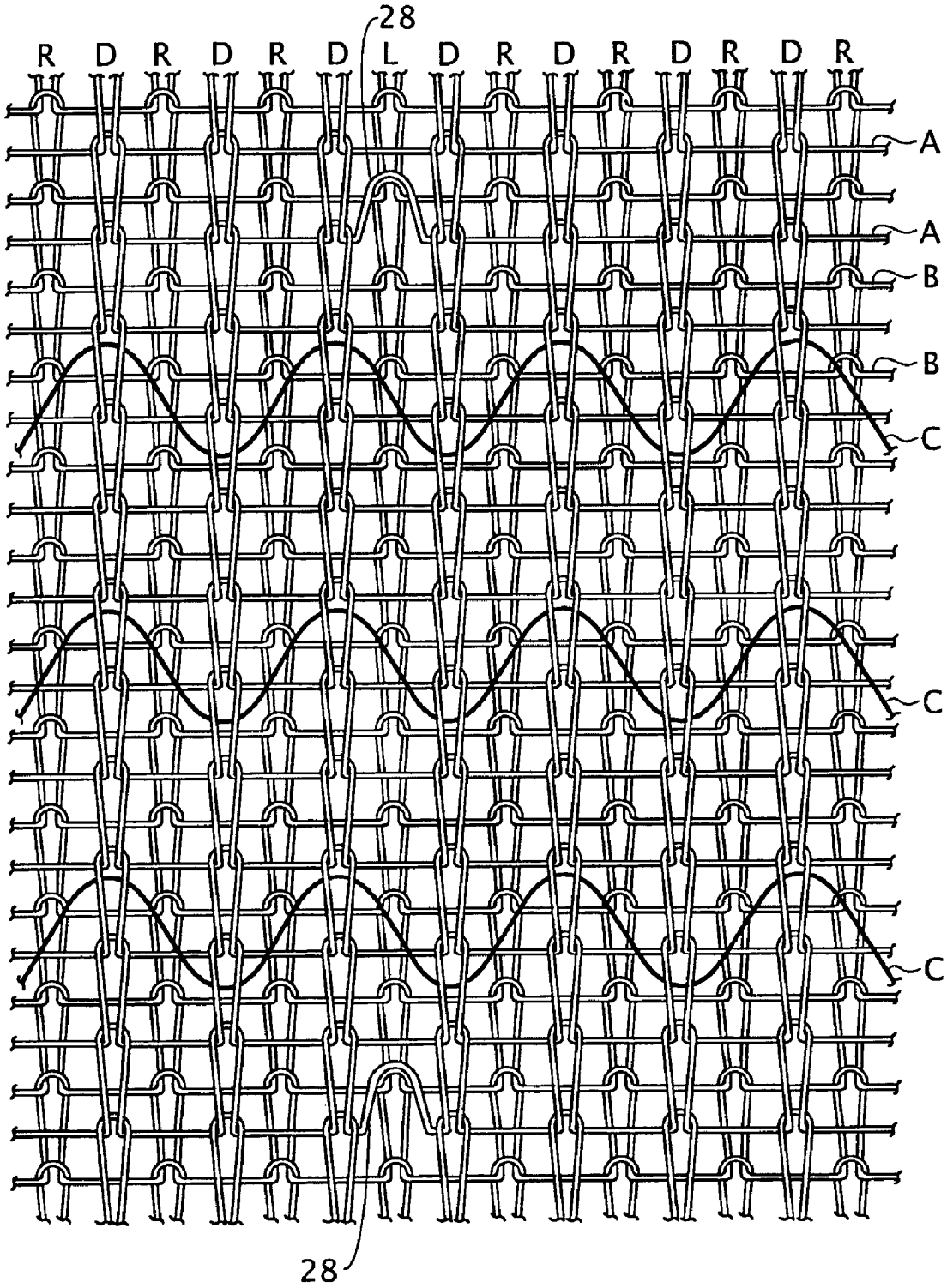
FIG. 3 is an enlarged diagrammatic view of the bi-ply fabric, illustrating in greater detail how air pockets or channels are formed by the fabric construction of the present invention.
Figure 4A:
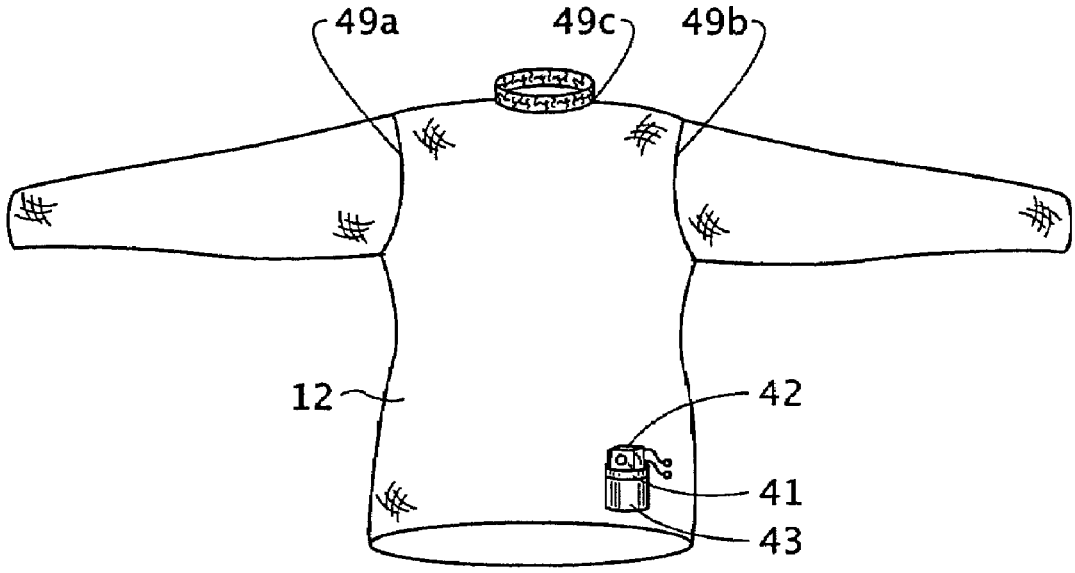
FIGS. 4A and 4B are views of a garment incorporating the bi-ply fabric of the present invention having conductive yarns incorporated therein and an electronic device connected thereto.
Figure 4B:
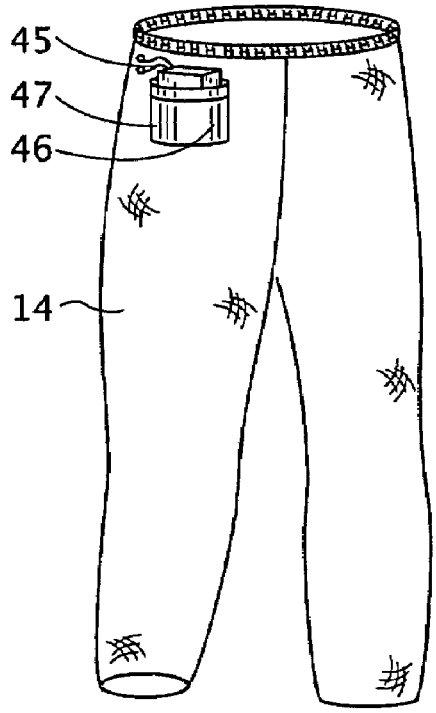

Referring particularly to FIGS. 2 and 3, and as will be explained in more detail below, the fabric construction of the present invention comprises at least one conductive wire yarn C that is, but is not limited to, stainless steel, copper, nichromium, silver, and combinations thereof.

Figure 5:
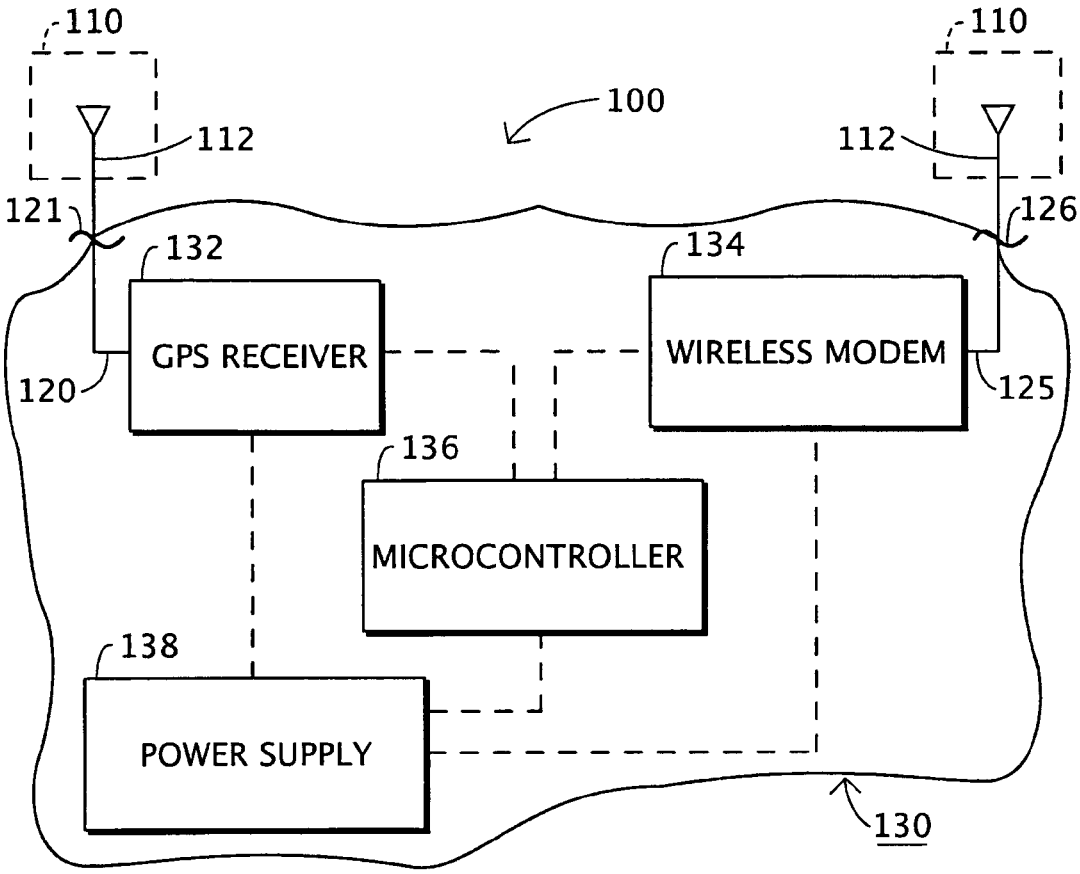
FIG. 5 is a schematic illustration of the global positioning device and antennae of the present invention.

Turning now to FIG. 5, an exemplary article of apparel 100 with a global positioning device therein is comprised of a fabric web 110, at least one yarn of conductive wire 112 incorporated into the fabric web 110, forming at least one antenna 120, 125, and a global positioning system (GPS) tracking unit 130. The one or more electrically conductive yarns of conductive wire form the antennae 120, 125 for the receipt and transmission of radio frequency signals when ends of the antenna 120 or 125 are interconnected to the receiver and transmission components of the GPS tracking unit 130 described below. As shown in FIG. 5, the GPS tracking unit is interconnectable at points 121 and 126 to the antennae 120,125. Thus, the GPS tracking unit 130 may be either permanently or releasably connected to antennae 120 and 125. Those skilled in the art will appreciate that the length of antenna required is readily determined based on the type of conductive material and the cross-section of the conductive material.

The GPS tracking unit 130 is a self-contained portable electronic device that sends its GPS location coordinates to a pre-determined e-mail recipient via a wireless cellular interface. As explained in greater detail below, the unit is battery powered.

The GPS tracking unit 130 comprises four functional components: the GPS controller (receiver) 132 that is operable on radio frequencies, a wireless modem (transmitter) 134, a microcontroller 136, and a power supply 138. The GPS controller 132, wireless modem 134, and microcontroller 136 are each interconnected to the power supply 138. As it is generally known in the art, a global positioning device is normally only a receiving unit, and not typically combined with a transmitting unit. As is also known in the art, the GPS tracking unit 130 is programmed, through the microcontroller 136, to calculate the precise longitudinal, latitudinal, and altitude information of the GPS tracking unit 130. This requires the GPS tracking unit 130 to obtain the locations of at least three satellites that are part of the Global Positioning System (GPS) system, and calculate the distance between the GPS tracking unit 130 and each of the satellites. As understood by those in the art, the GPS comprises a constellation of 27 Earth-orbiting satellites.

The GPS controller 132 comprises a Trimble Lassen SQ Receiver available from Trimble Navigation Limited of Sunnyvale, Calif. This compact controller 132 is printed circuit board mountable and releasably interconnectable to antenna 120. Alternatively, a redundant antenna may be incorporated into the controller 132 circuitry.

One suitable wireless modem (transmitter) 134 for the GPS tracking unit 130 is an AnyDATA GT-2000 Code-Division Multiple Access (CDMA) modem available from AnyDATA Corporation of Irvine, Calif. CDMA, a cellular technology, is any use of any form of spread-spectrum by multiple transmitters to send to the same receiver on the same frequency channel, at the same time, without harmful interference. Spread-spectrum refers to a technique in which a signal is transmitted in a bandwidth that is considerably greater than the frequency content of the original information to be transmitted. The CDMA interface is compatible with service providers such as the Verizon networks, for example.

In one embodiment, the microcontroller 136 of the GPS tracking unit 130 is configured to operate in a power conserving mode when worn as part of the article of apparel 100. This serves to conserve the life of the battery power supply 138. As such, the microcontroller 136 is a lower power type, able to be placed in a "Sleep" mode to conserve power when the unit is not receiving or transmitting.

The microcontroller 136 is configured/programmed to activate the wireless modem 134 at specified intervals and for specified durations. In one exemplary embodiment, the microcontroller 136 activates the wireless modem 134 every 14 minutes for a duration of one minute, thus producing a 15 minute interval between each time the modem is turned on. If any messages are received by the tracking unit 130 from a remote station, the microcontroller's 136 RAM memory will be updated and the GPS coordinates will be retrieved for transmission. Alternatively, the GPS tracking unit 130 and wireless modem 134 may be activated manually by the wearer of the article of apparel 100.

Although not limited thereto, the power supply 138 may be comprised of commercially available Nickel Metal Hydride batteries. The capacity of these batteries is 650 mAH, providing the GPS tracking unit 130 with an operational time of approximately four days between charging. An external 9V DC power supply (not shown) is needed to recharge the batteries.

In operation, upon each boot-up, the GPS tracking unit 130 will activate the wireless modem 134 to check its programming status. If not programmed, the unit 130 will search the network, e.g., the Verizon network, for its Wireless Mobile Directory Number (WMDN). When the WMDN is found, the tracking unit 130 will program itself with the appropriate identification code. As configured, the WMDN is the wireless modem's 134 phone number. Once the WMDN is programmed, the tracking unit 130 will activate for a period of 1 minute on a 14 minute interval following the last shutdown of the tracking unit 130. The wireless modem 134 then searches for any Short Messaging System (SMS) messages designated for it. These SMS messages are more commonly known in the art as Text Messages. When a remote station sends the tracking unit 130 a Text Message, the remote station will use a text messaging protocol, as is well known in the art. The following are examples of text message commands that may be transmitted to the GPS tracking unit 130 of the present invention, although the possible commands are not limited to these:

| | |
|---|---|
| #a or #A: | This command sets the callback address for the GPS tracking unit 130 to an email address, i.e., the email address that the tracking unit 130 will transmit to by default. The desired email address must be preceded by ">" symbol and ended by the "<" symbol. For example, "To: 610-334-5134, Message Body: #a>jdoe@remotestation .com<." The tracking unit 130 is programmed to acknowledge the change/update of the callback address by sending the message "Callback address updated" to the new default email address. |
| #n or #N: | This command sets the callback address for the GPS tracking number to a phone number (WMDN). The desired WMDN must be proceeded by ">" and followed by "<". For example, "To: 610-334-5134, Message Body: #n>7176155340<." The tracking unit 130 again will acknowledge the update of the callback number by sending the message "Callback address updated" to the new default phone number. |
| #c or #C: | This is the command for the current coordinates of the GPS tracking unit 130. When received, the tracking unit 130 will activate and retrieve the current coordinates. For example, "To: 610-334-5134, Message Body: #c". The coordinates will then be placed into a message that will be sent to the default callback address. |

Figure 6:
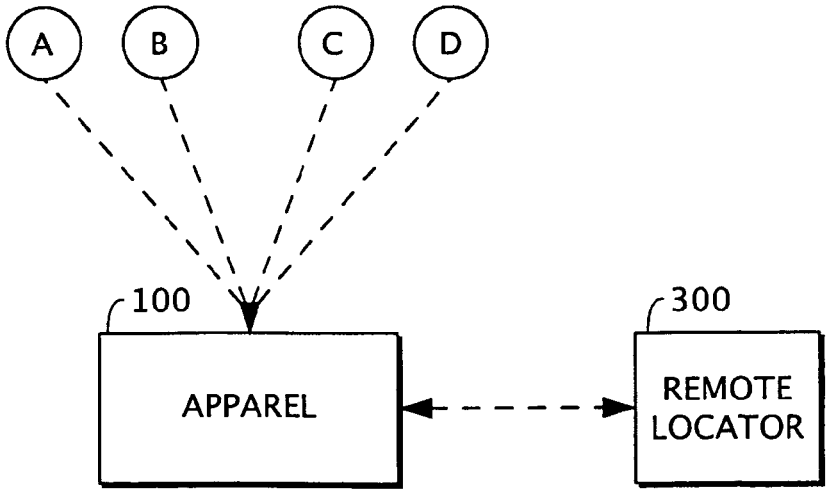
FIG. 6 is a schematic illustration of the operation of the global positioning system incorporated into the apparel of the present invention.

Turning now to FIG. 6, a further aspect of the present invention is directed to a system for locating and transmitting the position of an individual wearing an article of apparel 100 having the GPS tracking unit 130 described above incorporated therein.

The article of apparel 100 with the GPS tracking unit 130 receives a signal from at least three, and desirably four, satellites that are a part of the GPS constellation. The apparel 100 with the GPS tracking unit 130 is configured, as described herein, to retrieve the wearer's coordinates when activated. A remote ground-based locator 300 forms part of the system. For example, the remote locator 300 may comprise an email recipient via a wireless cellular interface.

Although the present invention has been described with preferred embodiments, it is to be understood that modifications and variations may be utilized without departing from the spirit and scope of the invention, as those skilled in the art will readily understand. Such modifications and variations are considered to be within the purview and scope of the appended claims and their equivalents.

I claim:

1. An article of apparel for determining location information via a global positioning system and transmitting the location information to a remote locator, comprising:

(a) two confronting fabric webs, one web overlying the other and the two webs being united at intervals;

(b) at least one yarn of wire formed between the confronting fabric webs, the at least one yarn of wire forming at least one antenna for receipt and transmission of radio frequency signals;

(c) a GPS receiver interconnected to the antenna, wherein the GPS receiver determines a location of the article of apparel via a global positioning system;

(d) a transmitter for transmitting the location of the article of apparel determined by the GPS receiver; and (e) a power supply interconnected to the GPS receiver and the transmitter.

2. The article of apparel of claim 1 wherein the at least one yarn is selected from the group consisting of stainless steel, copper, nichromium, silver, and combinations thereof.

3. The article of apparel of claim 1 wherein the at least one yarn of wire is between 27 AWG and 33 AWG.

4. The article of apparel of claim 1 wherein the GPS receiver is configured to operate in a power conserving mode and to activate upon receipt of the signal from a remote locator.

5. The article of apparel of claim 1 wherein the transmitter is programmed to transmit the location information to a remote receiver upon receipt of a signal from the remote locator.

6. The article of apparel of claim 1 wherein the power supply is re-chargeable and configured to be re-charged by 120 volt, 60 cycle, AC power.

7. An article of apparel for determining location information via a global positioning system and transmitting the location information to a remote locator, comprising:

(a) two confronting webs, each web being formed by a series of continuous lengths of yarn extending generally parallel to one another and having loops arranged in walewise and coursewise rows;

(b) one web overlying the other and the two webs being united at intervals by a tuck stitch of yarn of one web engaging the other web, the tuck stitches being spaced apart walewise by a plurality of courses to create channels therebetween the stitches, the channels extending walewise of the webs;

(c) at least one yarn of wire inserted therein between the two fronting webs and held generally parallel to the coursewise rows by said tuck stitches, the at least one yarn of wire forming an antenna for receipt and transmission of radio frequency signals;

(d) a GPS receiver interconnected to the antenna, wherein the GPS receiver determines a location of the article of apparel via a global positioning system;

(e) a transmitter for transmitting the location of the article of apparel determined by the GPS receiver; and (f) a power supply interconnected to the GPS receiver and the transmitter.

8. The article of apparel of claim 7 wherein the at least one yarn of wire is inserted under tension.

9. The article of apparel of claim 8 wherein the at least one yarn inserted under tension is selected from the group consisting of stainless steel, copper, nichromium, silver, and combinations thereof.

10. The article of apparel of claim 8 wherein the at least one yarn of wire inserted under tension is between 27 AWG and 33 AWG.

11. The article of apparel of claim 8 wherein the at least one yarn of wire inserted under tension is inserted at a tension of between about 4 grams and 6 grams.

12. The article of apparel of claim 7 wherein the power supply is configured to be re-charged by 120 volt, 60 cycle, AC power.

13. The article of apparel of claim 7 wherein the GPS receiver is configured to operate in a power conserving mode and to activate upon receipt of the signal from a remote locator.

14. The article of apparel of claim 7 wherein the transmitter is programmed to transmit the location information to a remote receiver upon receipt of a signal from the remote locator.

15. A system for determining location information via a global positioning system and transmitting the location information to a remote locator, comprising:

(a) an article of apparel, comprising:

(i) a fabric web;

(ii) at least one yarn of wire inserted under tension therein the fabric web, the at least one yarn of wire forming at least one antenna for receipt and transmission of radio frequency signals;

(iii) a GPS receiver interconnected to the antenna, wherein the GPS receiver determines a location of the article of apparel via a global positioning system;

(iv) a transmitter for transmitting the location of the article of apparel determined by the GPS receiver;

(v) a power supply interconnected to the GPS receiver and the transmitter; and (b) a remote locator.

16. The system of claim 15 wherein the at least one yarn inserted under tension is selected from the group consisting of stainless steel, copper, nichromium, silver, and combinations thereof.

17. The system of claim 15 wherein the at least one yarn of wire inserted under tension is between 27 AWG and 33 AWG.

18. The system of claim 16 wherein the at least one yarn of wire inserted under tension is inserted at a tension of between about 4 grams and 6 grams.

19. The system of claim 15 wherein the power supply is configured to be re-charged by 120 volt, 60 cycle, AC power.

20. The article of apparel of claim 15 wherein the GPS receiver is configured to operate in a power conserving mode and to activate upon receipt of the signal from a remote locator.

21. The article of apparel of claim 15 wherein the transmitter is programmed to transmit the location information to a remote receiver upon receipt of a signal from the remote locator.

* * * * *